US006634613B1

(12) United States Patent
Kaper et al.

(10) Patent No.: US 6,634,613 B1
(45) Date of Patent: Oct. 21, 2003

(54) SHOCK-ABSORBING PRODUCT CARRIER

(75) Inventors: Lloyd A. Kaper, Hamilton, MI (US); Robert T. Schaftenaar, Holland, MI (US)

(73) Assignee: EMH Systems, Holland, MI (US)

( * ) Notice: Subject to any disclaimer, the term of this patent is extended or adjusted under 35 U.S.C. 154(b) by 77 days.

(21) Appl. No.: 09/679,601

(22) Filed: Oct. 5, 2000

(51) Int. Cl.[7] ..... A47B 91/00

(52) U.S. Cl. ..... 248/346.01; 108/57.12; 108/57.28

(58) Field of Search ..... 248/346.01, 346.02, 248/548, 678, 687, 656, 616; 108/57.12, 57.16, 57.17, 57.18, 57.28, 56.3, 51.3

(56) References Cited

U.S. PATENT DOCUMENTS

| | | | | |
|---|---|---|---|---|
| 2,172,004 A | * | 9/1939 | Anderson | 248/616 |
| 3,524,415 A | | 8/1970 | Heiman | |
| 3,768,423 A | | 10/1973 | Cook, III et al. | |
| 3,891,170 A | | 6/1975 | Bricker et al. | |
| 3,902,692 A | | 9/1975 | Skinner | |
| 3,916,803 A | * | 11/1975 | Garcia | |
| 3,962,660 A | | 6/1976 | Duckett | |
| 4,013,020 A | | 3/1977 | Schoeller et al | |
| 4,051,787 A | * | 10/1977 | Nishitani et al. | |
| 4,079,907 A | * | 3/1978 | Mykleby | 108/55.1 |
| 4,146,205 A | | 3/1979 | Skinner | |
| 4,244,471 A | | 1/1981 | Plante | |
| 4,393,999 A | | 7/1983 | Forshee | |
| 4,809,618 A | | 3/1989 | Bell | |
| 5,101,964 A | | 4/1992 | Westphal | |
| 5,425,521 A | * | 6/1995 | Locke | |
| 5,570,643 A | * | 11/1996 | Werner | |

* cited by examiner

*Primary Examiner*—Korie Chan
(74) *Attorney, Agent, or Firm*—Diller, Ramik & Wight

(57) ABSTRACT

The invention is directed to a product carrier, pallet or skid formed of substantially homogeneous molded polymeric/copolymeric synthetic plastic material of a one-piece construction. The carrier includes an upper surface above which projects one or more elongated shock-absorbing fins, ribs or equivalent structure for absorbing impact-forces through deformation upon the carrier and a relatively heavy product carried thereby being dropped or mishandled. One or more fasteners snugly secure the product against the shock-absorbing fins of the carrier and are also in freely sliding relationship thereto to accommodate product movement relative to the carrier upon deformation of the shock-absorbing fins/structure. The carrier is also preferably constructed as an open frame with at least a pair of supporting feet being disposed in opposing relationship to each other and underlying a frame member of the product which in turn underlies a relatively heavy area thereof, such as a compressor of a refrigerator, to afford additional support upon deformation of the shock-absorbing fins/structure.

26 Claims, 4 Drawing Sheets

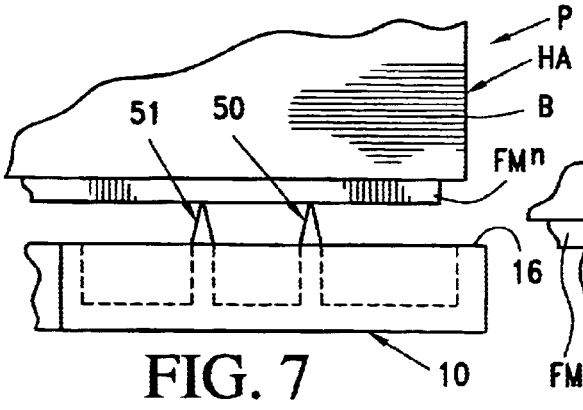
FIG. 7
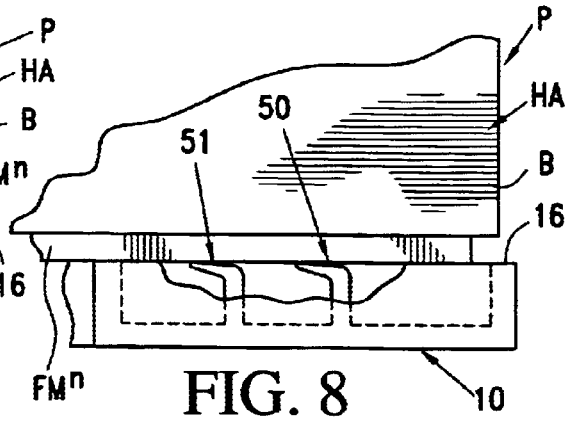
FIG. 8
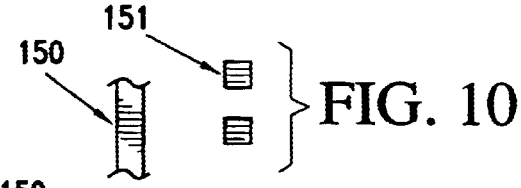
FIG. 10
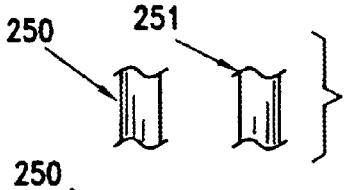
FIG. 12
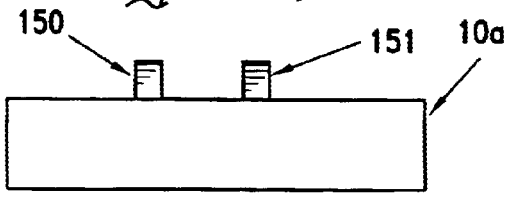
FIG. 9
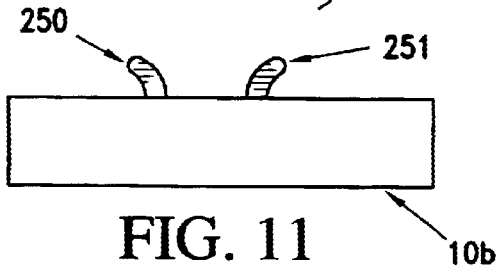
FIG. 11
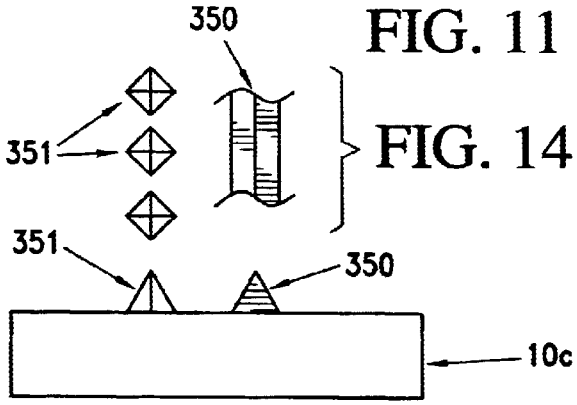
FIG. 14
FIG. 13
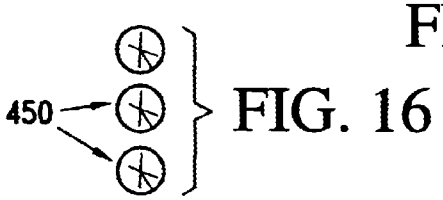
FIG. 16
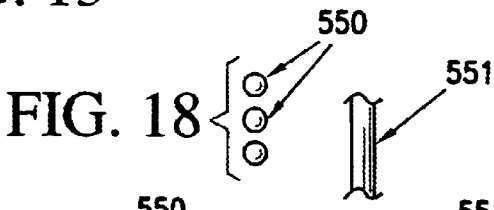
FIG. 18
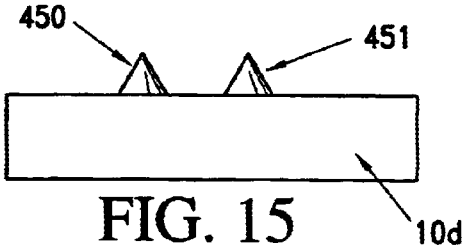
FIG. 15
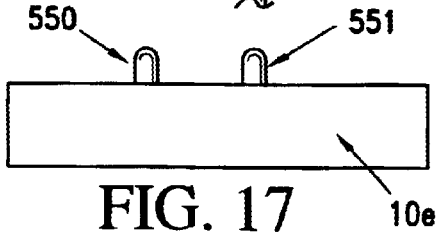
FIG. 17

SHOCK-ABSORBING PRODUCT CARRIER

BACKGROUND OF THE INVENTION

The invention is directed to a product carrier, such as a pallet, skid or the like, upon which a product can be assembled during production and thereafter supported during subsequent handling, storage and transportation. The product carrier preferably includes shock-absorbing characteristics to prevent damage to the product being supported if and when subjected to impact forces should, for example, the product and carrier be dropped.

DESCRIPTION OF RELATED ART

Conventional product carriers, pallets, skids and the like are quite common, including those made of wood and those molded from polymeric/copolymeric synthetic plastic material. U.S. Pat. Nos. 4,809,618; 4,393,999; 3,902,692 and 3,768,423 are exemplary of such integral one-piece pallets or skids made of plastic material upon which a product can be supported for handling, storage and transportation. Advantages of such pallets are specified in the latter patents, and particular reference is made to the advantages listed in U.S. Pat. No. 3,768,423 (column 1, lines 3 through 18) of a plastic pallet as compared to a wood pallet. These patents are indicative of the common utilization of integral, one-piece molded, reusable plastic pallets utilized for supporting a variety of different products.

U.S. Pat. Nos. 4,244,471 and 3,891,170 are of interest because they deal with a shipping pallet or skid for home appliances, such as refrigerators.

Finally, the overall simplicity and complexity of shipping structures, be they termed skids, pallets, carriers or bases, are exemplified by U.S. Pat. Nos. 3,962,660; 3,524,415; 5,101,964; 4,146,205 and 4,013,020.

SUMMARY OF THE INVENTION

The invention is directed to a product carrier and is intended for utilization beginning with assembly line utilization during the manufacture and/or fabrication of the specific product which is to be united thereto and carried thereby. For example, if the product carrier is to be used to support a refrigerator, the carrier is designed specifically for association and ease of assembly with the specific refrigerator which is to be manufactured along an assembly line. As early as possible during the manufacture of the refrigerator, a bottom or bottom frame members of the refrigerator are secured to the product carrier by any one of a number of attachment methods, such as bolts, clips, screws or snaps. As the unitized carrier and refrigerator are progressively assembled along the assembly line, the carrier functions as the refrigerator support through final assembly, packaging, storage, eventual shipment, sale, shipment to purchaser and eventual disassembly and installation. By constructing the carrier from hot molded polymeric/copolymeric synthetic plastic material by any one of injection, compression, bulk, extrusion, or blow molding or vacuum thermo-forming, a relatively inexpensive carrier can be produced particularly when its lifetime extends from initial product manufacture to installation. When being molded and particularly when being compression molded, the polymeric/copolymeric synthetic plastic material may also include filler material, such as wood chips, wood fibers, saw dust and the like.

By providing the product carrier with shock-absorbing characteristics as an integral feature thereof, the total "packaging" of a particular product is reduced through the elimination of support and cushioning materials (Styrofoam®, Homosote®, etc.) which is presently commonplace in the industry. A shock absorbing carrier formed by conventional molding processes from polymeric/copolymeric synthetic plastic material also provides consistent strength and design characteristics, improved product protection, flexibility of design, ease of attachment to a particular product, and each of handling after attachment to the product, all with overall cost improvement when utilized from initial product manufacture to eventual product installation.

In keeping with the foregoing, the novel shock-absorbing carrier of the present invention is formed preferably as a one-piece open polygonal base or frame formed of substantially homogeneous molded polymeric/copolymeric synthetic plastic material with or without filler material therein. The base includes an upper surface above which projects means for absorbing impact forces through deformation should the carrier and a relatively heavy product carried thereby be dropped or mishandled. The impact force-absorbing or shock-absorbing means are preferably pairs of substantially spaced, parallel, upwardly tapering fins or ribs upon which a bottom frame of the product, such as a refrigerator, normally rests, but upon high impact forces being caused by the unitized carrier and product (refrigerator) being dropped, the fins crush and/or fold to absorb the impact forces and prevent product damage.

In further accordance with the invention, the carrier is secured to a base of the product, again preferably a refrigerator or similar home appliance, by a bolt or a screw which is in free sliding telescopic relationship to the carrier and is threaded or otherwise fixed to a bottom or bottom frame member of the product. A plurality of such bolts or screws provide a rigid connection between the carrier and the product but under an impact force, which causes the impact force-absorbing means to compress, break or bend, the fastener or fasteners are free to move relative to the carrier assuring total absorption of the impact forces by the impact force-absorbing means.

In one specific embodiment of the invention designed to support refrigerators having a bottom cross piece or frame member supporting a compressor, the carrier is preferably of a polygonal open frame construction having impact force-absorbing means in the form of spaced, parallel shock-absorbing ribs disposed along opposite substantially parallel side members from each of which projects a supporting foot. The supporting feet are disposed below and spaced from a bottom crosspiece of the refrigerator which supports thereupon a compressor of the refrigerator. When subjected to impact forces, the impact force-absorbing or shock absorbing ribs collapse, compress and/or bend and toward maximum impact, the refrigerator cross piece bottoms against the opposing feet which thereby underlyingly contactingly support the bottom cross piece and prevent damage thereto and to the compressor supported thereby.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 7 is a fragmentary diagrammatic side elevational view of FIG. 6, and illustrates the normal nonimpact support relationship between the shock-absorbing fins of the A carrier and a bottom of the refrigerator.

FIG. 8 is a fragmentary diagrammatic side elevational view, partially in cross-section, of the carrier and refrigerator of FIG. 7, and illustrates the shock absorbing fins or rails being crushed and/or bent under impact forces, such as might be generated should the unitized refrigerator/carrier be dropped or mishandled.

FIGS. 9 and 10 are respective diagrammatic side elevational and fragmentary top plan views, and illustrate impact force-absorbing or shock-absorbing means in the form of a generally rectangular shock-absorbing rail and adjacent thereto a series of rectangular relatively spaced upstanding shock-absorbing fingers.

FIGS. 11 and 12 are respective diagrammatic side elevational and fragmentary top plan views, and illustrate concave and convex or concavo-convex shock-absorbing rails in parallel spaced relationship to each other.

FIGS. 13 and 14 are diagrammatic side elevational and fragmentary top plan views, respectively, and illustrate a triangular shock-absorbing rail and adjacent thereto a plurality of spaced pyramid-like shock-absorbing fingers.

FIGS. 15 and 16 are respective side elevational and top plan views, and illustrate two rows of conical shock-absorbing fingers.

FIGS. 17 and 18 are respective diagrammatic side elevational and fragmentary top plan views, and illustrate an elongated shock-absorbing rail and a plurality of adjacent spaced fingers, each having rounded upper ends.

DETAILED DESCRIPTION OF THE INVENTION

Figure 2:
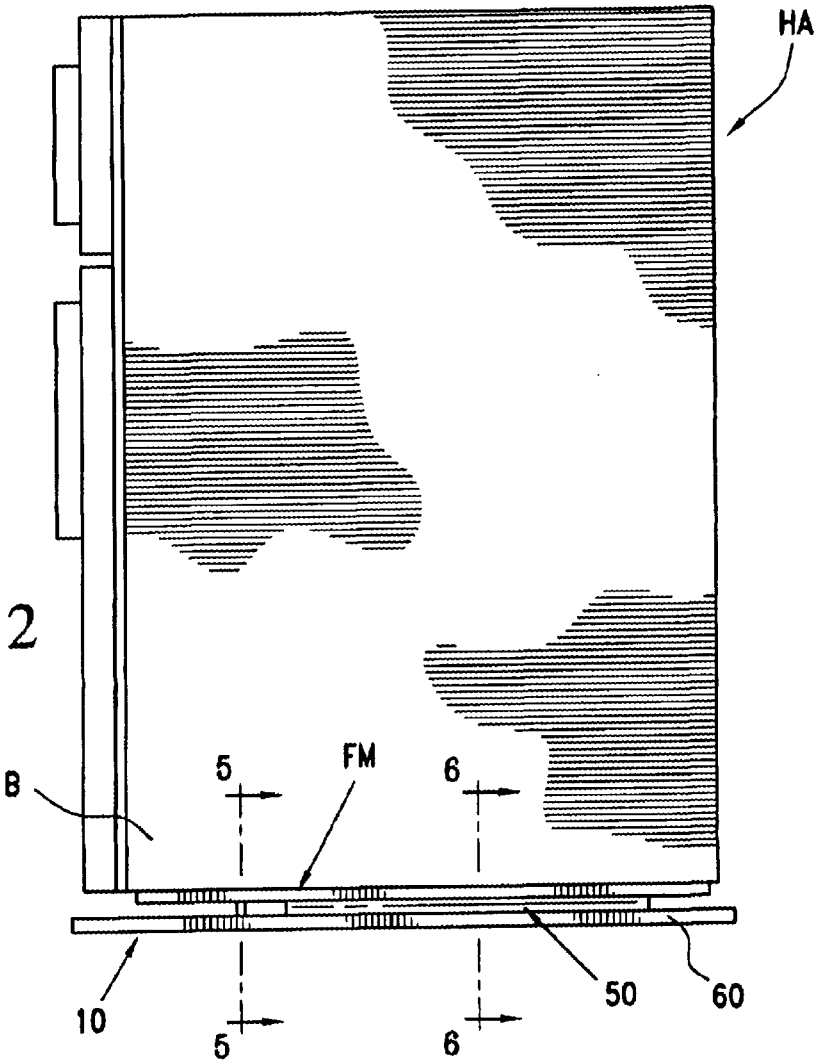
FIG. 2 is a side evational view of the product carrier and refrigerator of FIG. 1.
Figure 1:
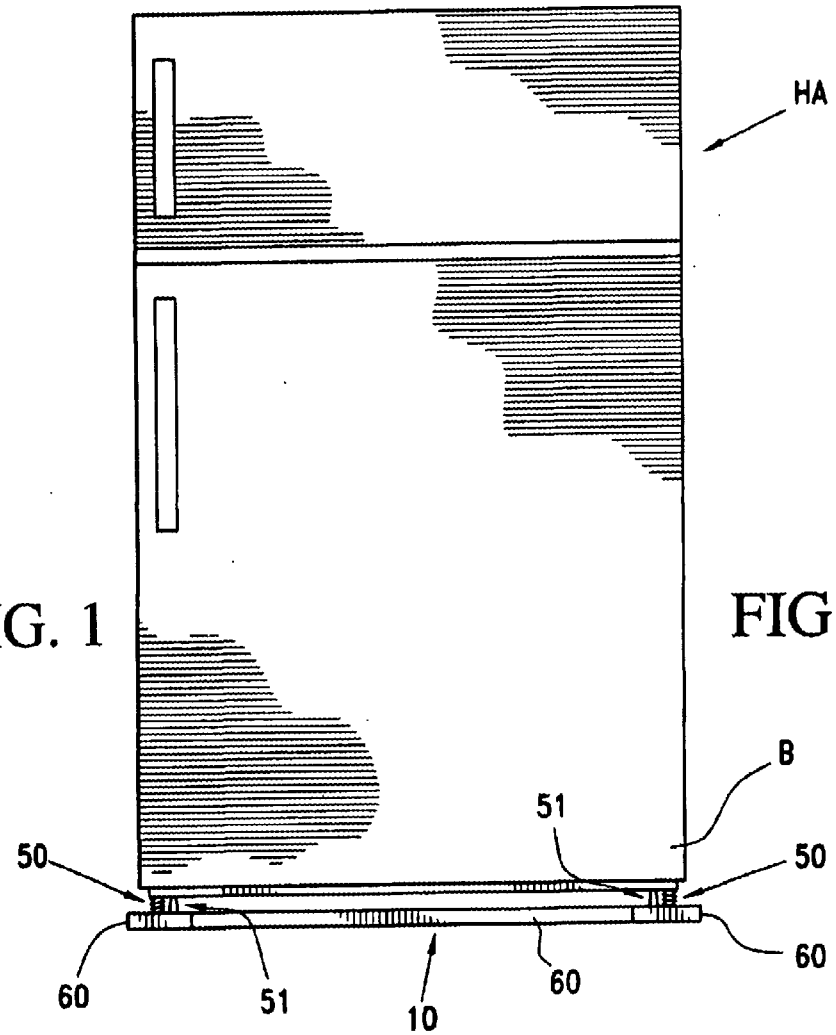
FIG. 1 is a front respective view of a product carrier of the invention, and illustrates a refrigerator supported thereupon.

A novel shock-absorbing carrier, pallet, skid or base constructed in accordance with this invention is illustrated in FIGS. 1 through 3, 5 and 6 of the drawings and is generally designated by the reference numeral 10.

The carrier 10 is constructed and designed for connection to and support of a relatively heavy product, such as a household appliance HA (FIGS. 1 through 3, 5 and 6) which is illustrated as a refrigerator for purposes of description. However, the home appliance HA can as well be a freezer, an oven, a television set or most any product which necessitates bottom-support during manufacture, storage, shipment and/or the like up to eventual installation. The product carrier 10 is preferably utilized initially at the beginning stages of the fabrication of the refrigerator HA by suitably securing thereto and building thereupon a bottom B (FIG. 3) of the refrigerator HA which may include a number of metal frame members, such as the frame member FM (FIG. 3) upon which is seated and supported a conventional compressor C. The bottom B, the frame member FM or any number of other frame members FM$^n$ (FIGS. 5 and 6) are supported by and are secured to the product carrier 10 in a manner to be described hereinafter which optimizes the manufacturing process from beginning to end, including subsequent to inspection when all that need be done to the overall "package" P of the product carrier 10 and the product HA of FIGS. 1 through 3, 5 and 6 is to wrap the same in protective material to prevent damages from minor scratches or scrapes during storage and/or transportation. The entire package P can thus be shipped absent the utilization of conventional cushioning and shock-absorbing materials, such as Styrofoam®, Homosote(®, etc., due to the shock-absorbing nature of the product carrier 10, as will be more apparent immediately hereinafter.

The product carrier 10 is formed as a one-piece base of substantially homogeneous molded polymeric/copolymeric material by any one of conventional injection molding, compression molding, blow molding, bulk molding, extrusion molding, vacuum thermo-forming or the like, again with or without filler material therein.

Figure 5:
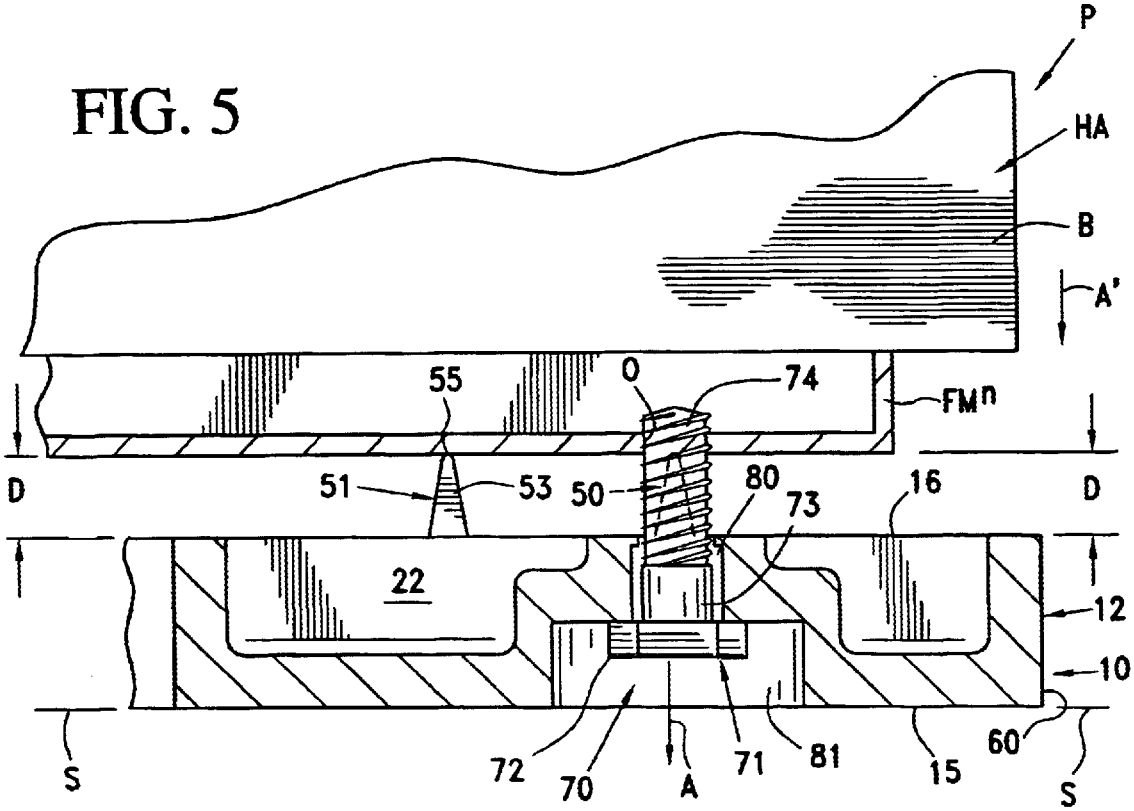
FIG. 5 is an enlarged fragmentary cross-sectional view taken generally along line 5—5 of FIG. 2, and illustrates details of a bottom frame member of the refrigerator supported upon one of a pair of shock-absorbing or impact force-absorbing fins or rails and a screw or bolt securing the carrier to the refrigerator.
Figure 6:
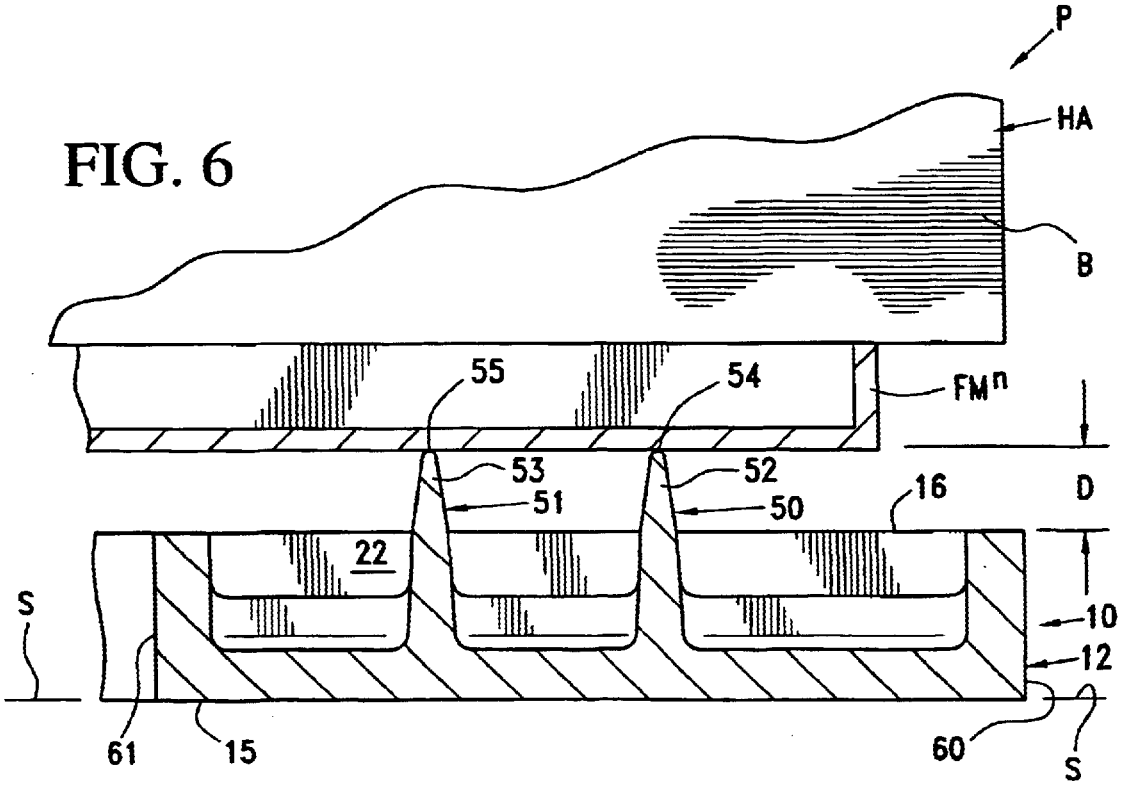
FIG. 6 is an enlarged fragmentary cross-sectional view taken generally along line 6—6 of FIG. 2, and illustrates details of the impact force-absorbing fins or ribs supporting a bottom of the product/refrigerator in spaced relationship to an upper surface of the carrier.

The product carrier or base 10 is a substantially open polygonal frame defined by a pair of spaced, generally parallel frame portions 11, 12 (FIG. 3) and normal thereto another pair of generally parallel frame portions 13, 14. The overall product carrier 10 and the frame portions 11 through 14 thereof include a lower surface 15 and an uppermost surface 16 (FIGS. 5 and 6). The lower surface 15 is substantially flat and uni-planar whereas the upper surface 16 is broken by a plurality of recesses 21 through 24 of different sizes and shapes formed in the frame portions 11, 12; recesses 25 formed in the frame portion 13 and recesses 26, 27 formed in the frame portion 12.

The recesses 21 through 24 are set-off by and in turn defined reinforcing ribs 30 through 34 of the frame portions 11, 12; reinforcing ribs 35 of the frame portion 25 and reinforcing ribs 36, 37 of the frame portion 16. The purpose of the recesses 21 through 26 is to lighten the overall weight of the product carrier 10 while the purpose of the reinforcing ribs 30 through 37 is to strengthen and rigidify the product carrier 10, particularly to resist torque or torsion forces. The ribs 33, 35, and 37 lie in a plane below the upper surface 16 whereas the upper surfaces of the remaining ribs 30, 31, 32, 34 and 36 lie in the plane of the upper surface 16.

Figure 3:
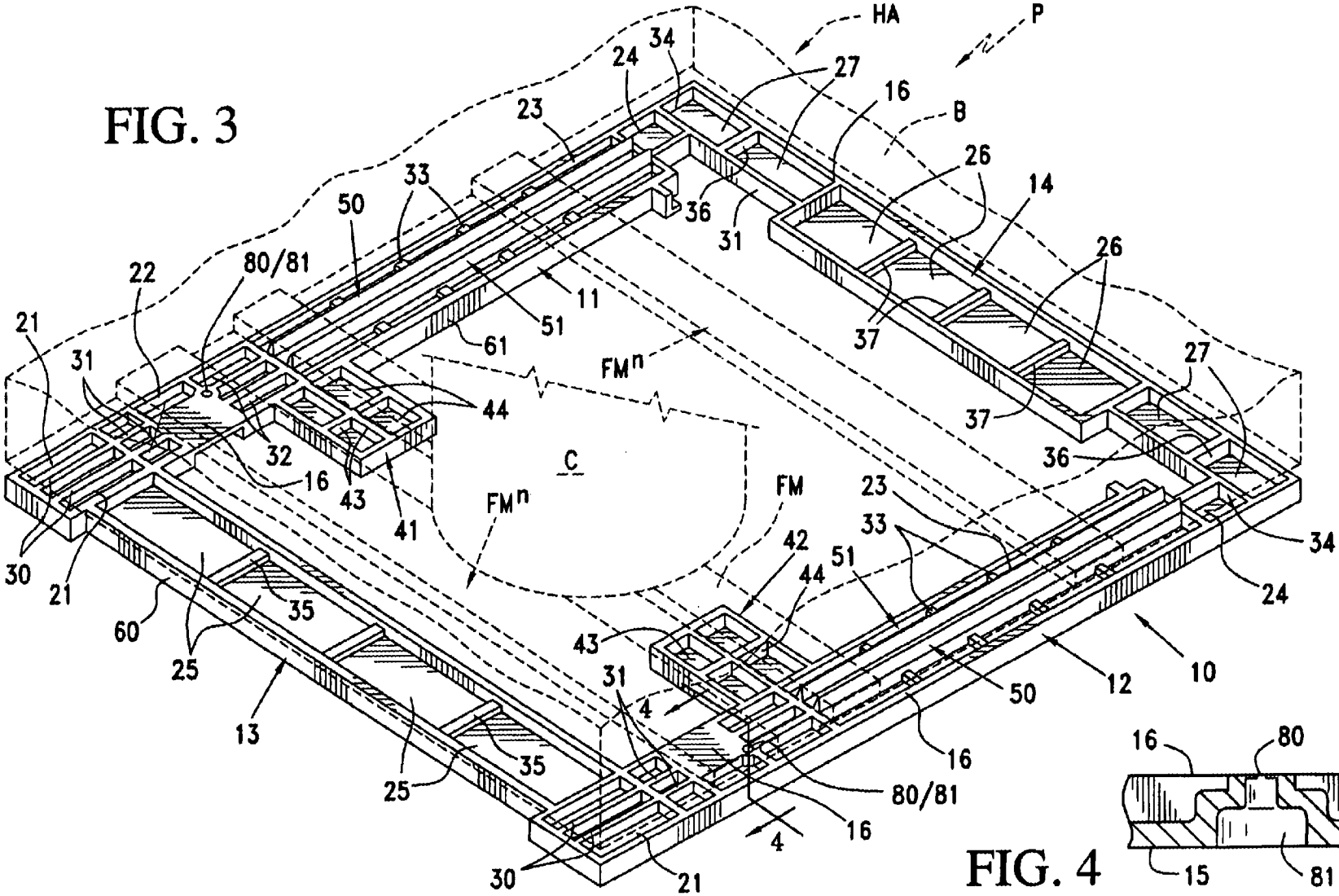
FIG. 3 is a top perspective view of the product carrier of the invention, and illustrates in phantom outline a bottom of a product, such as a refrigerator, supported thereupon.

The frame portions 11, 12 also include projecting frame portions, feet portions or feet 41, 42 which are in opposed relationship to each other and underlie and contactingly support the frame member FM of the bottom B of the refrigerator HA (FIG. 3). As is well known, compressors C are extremely heavy and should the package P be dropped, the feet 41, 42 offer additional underlying support to the frame member FM to prevent the same from bending, breaking or otherwise becoming damaged. As in the case of the other frame portions 11 through 14 of the product carrier 10, the feet 41, 42 similarly include recesses 43 for weight reduction and ribs 44 for reinforcement or strength.

Identical means 50, 51 (FIGS. 1–3, and 5–7) in the form of elongated substantially parallel impact force-absorbing or shock-absorbing fins or ribs 50, 51 are arranged along a major length of each of the frame portions 11, 12 in board of an outer peripheral edge 60 and outboard of an in board peripheral edge 61 of the product carrier 10. The elongated shock-absorbing fins 50, 51 extend over a major length of the frame portions 11, 12 and respective upper end portions 52, 53 (FIGS. 5 and 6) of each terminate in respective noses 54, 55 located a predetermined distance D (FIGS. 5 and 6) above the upper surface 16 of the product carrier 10. One of the frame members $FM^n$ of the base B of the refrigerator HA is shown seated upon the noses 54, 55 of the shock-absorbing fins 50, 51, respectively, in FIGS. 5 and 6 of the drawings. The specific polymeric/copolymeric material, thickness, strength, compressibility, filler material content or not or the percentage thereof, etc. of the fins 50, 51 is such that the shock-absorbing fins 50, 51 will easily support the overall weight of the refrigerator HA under normal conditions and maintain the spacing D at a desired design dimension. However, under severe impact loads, such as the package P being dropped, the impact forces created by gravity upon the package P contacting a surface abruptly will cause the shock-absorbing fins 50, 51 to collapse and/or bend from the normal supporting position shown in FIGS. 6 and 7 to the shock-absorbing or impact force-absorbing condition thereof shown in FIG. 8. By thus bending, compressing or collapsing, damage which might otherwise occur to the refrigerator HA is precluded.

Figure 4:
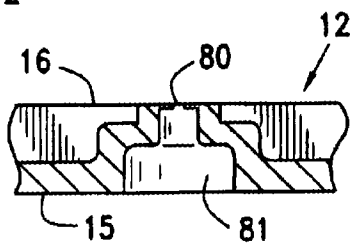
FIG. 4 is an enlarged fragmentary cross-sectional view taken generally along line 4—4 of FIG. 3, and illustrates one of two or more openings formed in the carrier through which pass fasteners for securing the carrier to a bottom or underframe of the product/refrigerator.

Reference is specifically made to FIGS. 3 and 5 of the drawings which illustrate novel means generally designated by the reference numeral 70 for securing the refrigerator HA or a similar heavy product to the product carrier or base 10 while the product HA is supported upon the noses 54, 55 of the respective shock-absorbing fins 50, 51. The securing means 70 can be any number of conventional fastening means, such as clips, bolts, screws or snaps, but in keeping with the present invention, the preferred securing means or fastening means 70 includes one or more bolts 71, each including an enlarged head 72, a stem 73 and a threaded end portion 74 (FIG. 5). A bore or opening 80 and a counterbore 81 (FIGS. 3, 4 and 5) are provided in the product carrier 10, and two such bores and counterbores are illustrated in FIG. 3, one being formed in the frame portion 11 and the other being formed in the frame portion 12.

The bolt 70 and a similar bolt (not shown) are passed through each of the openings/counterbores 80, 81 of the frame portions 11, 12 from beneath the product carrier 10 and are threaded into a threaded opening O in the frame member $FM^n$ (FIG. 5) of the base B of the refrigerator HA. The opening O is conventionally threaded to accommodate the threaded stem of conventional casters or rollers, but instead might be simply a male/female snap connector of a known conventional construction in which case a like female/male snap connector would be utilized in lieu of the threaded bolt 70. However, irrespective of the specifics of the securing means or fastening means 70, in the present preferred embodiment of the invention the bolt 71 is threaded sufficiently tight to snugly hold the frame member $FM^n$ against the noses 54, 55 of the fins 50, 51 along each of the frame portions 11, 12 without adversely deforming or deflecting the tapered portions 52, 53 thereof or the overall shock absorbing fins 50, 51 themselves, in the manner best illustrated in FIGS. 1–3 and 5–7 of the drawings. It is to be understood that more than two such securing means 70 can be utilized in keeping with the present invention so long as the functional characteristics remain the same, namely, the securing or fastening means snugly secure the refrigerator HA to the product carrier 10 and, most importantly, effect a movable or sliding connection between the bolt 71 and bore/counterbore 80, 81 of the product carrier 10 to allow the bolt 71 to slide downwardly in the direction of the arrow A of FIG. 5 should the package P be dropped against a surface S (FIG. 5) in the direction of an arrow A'. When the product carrier 10 initially impacts the surface S and is abruptly stopped thereby, the refrigerator HA continues downward movement under its momentum causing the shock-absorbing fins 50, 51 to compress, crush and/or bend in the manner heretofore described and shown in FIG. 8, and during the latter descent of the refrigerator HA, the bolt/bolts 71 move downwardly with the enlarged head/heads 72 descending further into the counterbore/counterbores 81 in the absence of offering any resistance to the momentum descent of the refrigerator HA which is accommodated solely by the compression and/or bending of the shock-absorbing fins 50, 51. In this manner, the refrigerator HA is securely fastened to the product carrier 10 as part of the overall package P while the "lost motion" connection between the fastener(s) 71 and the product carrier 10 permits optimum operability of the shock-absorbing fins 50, 51. Accordingly, the overall construction of the product carrier 10 assures ease of handling and attachment to the product HA thereto, consistent strength and design with attendant design flexibility, improved product protection while eliminating the added expense of conventional support and cushioning materials, and the latter advantages are accomplished at relatively low cost.

While the preferred embodiment of the invention has been described herein, variations in the specifics of the shock-absorbing means 50, 51 are considered to be within the scope of the invention and several alternatives are illustrated in FIGS. 9 through 18 of the drawings in which each carrier has been illustrated diagrammatically and is identified by reference characters 10*a* through 10*e* in respective FIGS. 9, 11, 13, 15 and 17. Except for details of the shock-absorbing means which are to be described immediately hereinafter, the construction of the product carriers 10*a* through 10*e* correspond substantially identically to the characteristics heretofore described with respect to the product carrier 10.

In FIGS. 9 and 10 of the drawings, shock-absorbing means 150, 151 are illustrated which correspond to the respective shock-absorbing means 50, 51, but in this case the shock-absorbing means 150 is a single elongated shock-absorbing rail of a relatively square profile, and adjacent thereto and spaced therealong, as well as being spaced from each other, are a plurality of generally rectangular upstanding shock-absorbing posts 151. The shock-absorbing means 150, 151 are associated with the product carrier 10*a* and a product HA structurally and functionally substantially identical to that described relative to the product carrier 10 to essentially collapse, compress or become progressively crushed when subject to impact forces should a "package" formed therefrom be dropped.

The product carrier 10*b* of FIGS. 11 and 12 includes two elongated side-by-side shock-absorbing rails 250, 251, each of a concavo-convex configuration, and each being capable of being compressed, bent or deflected under impact loads.

In FIGS. 13 and 14, shock-absorbing means 350 is in the form of a single elongated rail of a triangular cross-sectional configuration tapering upwardly and adjacent thereto is a plurality of spaced pyramid-like shock-absorbing means or projections 351.

In FIGS. 15 and 16, shock-absorbing means 450, 451 are each of an upwardly projecting conical configuration and are aligned in two rows in parallel relationship to each other and in spaced relationship in each row.

In FIGS. 17 and 18, shock-absorbing means 550 are a plurality of spaced cylindrical fingers having rounded ends and adjacent thereto is an elongated shock-absorbing rail 551 having a rounded upper edge.

Although a preferred embodiment of the invention has been specifically illustrated and described herein, it is to be understood that minor variations may be made in the apparatus without departing from the spirit and scope of the invention, as defined the appended claims.

What is claimed is:

1. A shock-absorbing carrier for a relatively heavy product comprising a one-piece base formed of substantially homogeneous molded polymeric/copolymeric synthetic plastic material, said base including an upper surface terminating at an outer peripheral edge defining a predetermined configuration of said base, means projecting above said upper surface for supporting a relatively heavy product in spaced relationship to said upper surface, said projecting means being constructed and arranged for absorbing impact forces through deformation of said projecting means upon the carrier and a relatively heavy product carried thereby being dropped or mishandled, means for securing a relatively heavy product to said base with a lower surface of the product in contact with said projecting means, and means for effecting a movable connection between said securing means and said base up on defomation of said projecting mean.

2. The shock-absorbing carrier as defined in claim 1 wherein said base is a substantially open frame.

3. The shock-absorbing carrier as defined in claim 1 wherein said effecting means is a sliding connection between said securing means and said base.

4. The shock-absorbing carrier as defined in claim 1 wherein said securing means is a bolt.

5. The shock-absorbing carrier as defined in claim 1 wherein said base is a substantially open frame having a pair of inwardly directed supporting feet.

6. The shock-absorbing carrier as defined in claim 1 wherein said securing means is a screw.

7. The shock-absorbing carrier as defined in claim 1 wherein said base is a substantially open frame having a pair of inwardly directed supporting feet in opposing relationship to each other.

8. The shock-absorbing carrier as defined in claim 1 wherein said base includes an opening, and said securing means is in movable relationship to said opening.

9. The shock-absorbing carrier as defined in claim 1 wherein said base includes an opening, and said securing means is in sliding relationship to said opening.

10. The shock-absorbing carrier as defined in claim 1 wherein said base includes an opening, and said securing means is in telescopic relationship to said opening.

11. The shock-absorbing carrier as defined in claim 1 wherein said base includes an opening, said securing means is a fastener having a stem and an enlarged head, said stem passes through said opening, and said enlarged head seats in a counter opening located between said first-mentioned opening and a lower surface of said base.

12. The shock-absorbing carrier as defined in claim 1 wherein said base includes an opening, said securing means is a fastener having a stem and an enlarged head, said stem passes freely slidably through said opening, and said enlarged head seats in a counter opening located between said first-mentioned opening and a lower surface of said base.

13. The shock-absorbing carrier as defined in claim 1 wherein said impact force-absorbing projecting means include at least one rib.

14. The shock-absorbing carrier as defined in claim 1 wherein said impact force-absorbing projecting means include at least one rib tapering in an upward direction.

15. The shock-absorbing carrier as defined in claim 1 wherein said impact force-absorbing projecting means include at least one rib at each of two opposite sides of said base.

16. The shock-absorbing carrier as defined in claim 1 wherein said impact force-absorbing projecting means include at least a pair of spaced ribs.

17. The shock-absorbing carrier as defined in claim 1 wherein said impact force-absorbing projecting means include at least a pair of spaced ribs at each of two opposite sides of said base.

18. The shock-absorbing carrier as defined in claim 1 wherein said impact force-absorbing projecting means include at least one rib concavo-convex curving in an upward direction.

19. The shock-absorbing carrier as defined in claim 1 wherein said impact force-absorbing projecting means include a plurality of fingers.

20. The shock-absorbing carrier as defined in claim 1 wherein said impact force-absorbing projecting means include a plurality of cones.

21. The shock-absorbing carrier as defined in claim 1 wherein said impact force-absorbing projecting means include a plurality of pyramids.

22. The shock-absorbing carrier as defined in claim 1 wherein said impact force-absorbing projecting means include a plurality of cylinders.

23. The shock-absorbing carrier as defined in claim 1 wherein said base is a substantially polygonal open frame having a pair of inwardly directed supporting feet in opposing relationship to each other.

24. The shock-absorbing carrier as defined in claim 23 wherein said frame is defined by opposite frame portions from each of which projects one of said supporting feet, and said opposite frame portions each include at least one of said impact force-absorbing projecting means and at least one of said securing means.

25. The shock-absorbing carrier as defined in claim 24 including means for effecting a movable connection between said securing means and said base.

26. The shock-absorbing carrier as defined in claim 24 including means for effecting a sliding connection between said securing means and said base.

* * * * *